US010443547B2

(12) United States Patent
Kim

(10) Patent No.: US 10,443,547 B2
(45) Date of Patent: Oct. 15, 2019

(54) EXHAUST GAS RECIRCULATION VALVE

(71) Applicants: HYUNDAI MOTOR COMPANY, Seoul (KR); KIA MOTORS CORPORATION, Seoul (KR)

(72) Inventor: Jong Gu Kim, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/832,530

(22) Filed: Dec. 5, 2017

(65) Prior Publication Data

US 2019/0113009 A1 Apr. 18, 2019

(30) Foreign Application Priority Data

Oct. 17, 2017 (KR) ..... 10-2017-0134762

(51) Int. Cl.

*F02M 26/63* (2016.01)
*F02M 26/70* (2016.01)
*F02M 26/72* (2016.01)
*F02M 26/74* (2016.01)

(52) U.S. Cl.

CPC ..... *F02M 26/63* (2016.02); *F02M 26/70* (2016.02); *F02M 26/72* (2016.02); *F02M 26/74* (2016.02)

(58) Field of Classification Search

CPC ..... F16K 31/02; F16K 31/0658; F16K 31/44; F02M 26/63; F02M 26/70; F02M 26/72; F02M 26/74

USPC ..... 123/568.11, 568.15, 568.17–568.19, 123/568.21, 568.26, 80 D, 80 DA, 80 DB, 123/80 R; 251/129.14, 129.15, 214

See application file for complete search history.

(56) References Cited

U.S. PATENT DOCUMENTS 3,127,904 A * 4/1964 Stillwagon ..... F16K 1/2265 137/315.24
4,291,863 A * 9/1981 Gachot ..... F16K 1/2268 251/214
5,630,571 A * 5/1997 Kipp ..... F02D 9/06 251/214
2012/0193562 A1* 8/2012 Takai ..... F02D 9/106 251/214
2013/0001882 A1* 1/2013 Voigtlaender ..... F02D 9/106 277/350
2013/0048895 A1* 2/2013 Hodebourg ..... F02D 9/04 251/308
2014/0182567 A1* 7/2014 Lim ..... F02M 25/0787 123/568.12
2015/0034854 A1* 2/2015 Gutmann ..... F16K 1/221 251/250.5
2017/0268466 A1* 9/2017 Lim ..... F02M 26/70

* cited by examiner

*Primary Examiner* — John Kwon
*Assistant Examiner* — Johnny H Hoang
(74) *Attorney, Agent, or Firm* — Knobbe Martens Olson & Bear LLP

(57) ABSTRACT

An exhaust gas recirculation (EGR) valve is disclosed. The EGR valve includes a housing defining a flow path for exhaust gas recirculation, a flap for opening and closing the flow path, and an actuator for generating force for rotating the flap. The EGR valve includes further includes a three-arm linkage connecting between an output shat of the actuator and a rotational shaft of the flap.

6 Claims, 7 Drawing Sheets

EXHAUST GAS RECIRCULATION VALVE

CROSS-REFERENCE TO RELATED APPLICATION

This application is based on and claims the benefit of priority to Korean Patent Application No. 10-2017-0134762, filed on Oct. 17, 2017, in the Korean Intellectual Property Office, the disclosure of which is incorporated herein in its entirety by reference.

TECHNICAL FIELD

The present disclosure relates to an exhaust gas recirculation (EGR) valve and, more particularly, to an EGR valve capable of providing stable opening and closing performance and effectively preventing wear occurring between a flap and a housing.

BACKGROUND

Various techniques have been researched and developed for reducing combustion heat during combustion in an internal combustion engine to reduce emissions of nitrogen oxides ($NO_x$), hydrocarbons, and the like, and reducing a mixture ratio of air and fuel to improve fuel efficiency.

As a representative technique for reducing combustion heat and $NO_x$ emissions and improving fuel efficiency, an exhaust gas recirculation (EGR) system has been researched and developed.

The EGR system includes an EGR conduit for circulating EGR gas from an exhaust system to an intake system, an EGR cooler for cooling temperature of the EGR gas, and an EGR valve for regulating the flow of the EGR gas.

The disclosure of this section is to provide background of the invention. Applicant notes that this section may contain information available before this application. However, by providing this section, Applicant does not admit that any information contained in this section constitutes prior art.

SUMMARY

An EGR valve includes a housing having a flow path, a flap rotatably provided to open and close the flow path of the housing, and a drive unit rotating the flap. The drive unit includes an actuator such as a drive motor, and a transmission mechanism transmitting power of the actuator to the flap.

The EGR valve is necessary not only to ensure structural safety for opening and closing operations of the flap but also to have a structure for protecting the actuator from high temperature of the EGR gas passing through the EGR valve.

The present disclosure has been made to solve the above-mentioned problems occurring in the prior art while advantages achieved by the prior art are maintained intact.

An aspect of the present disclosure provides an exhaust gas recirculation (EGR) valve capable of ensuring structural safety for smoothly transmitting power of an actuator to a flap to thereby provide stable opening and closing performance, and preventing wear occurring between an external surface of the flap and an internal surface of a valve housing.

According to an aspect of the present disclosure, an EGR valve may include: a valve housing having a flow path; a flap opening and closing the flow path of the valve housing, and having a shaft and a hub receiving the shaft; an actuator generating torque for rotating the flap; and a torque transmitting mechanism transmitting the torque of the actuator to the flap, wherein the torque transmitting mechanism may include a first lever connected to an output shaft of the actuator, a second lever connected to the flap, and an intermediate link connected between the first lever and the second lever, the intermediate link may be inclined relative to the first lever and the second lever, a first bushing and a second bushing may be symmetrically provided at both ends of the hub, and a third bushing and a fourth bushing may be provided on an internal surface of the valve housing, and be capable of being brought into contact with the first bushing and the second bushing, respectively.

The first lever may be extended along a first axis, and one end of the first lever may be pivotally (rotatably) connected to the output shaft of the actuator, and the other end of the first lever may be pivotally connected to one end of the intermediate link by a first pivot pin.

The second lever may be extended along a second axis, and one end of the second lever may be connected to one end of the shaft, and the other end of the second lever may be pivotally (rotatably) connected to the other end of the intermediate link by a second pivot pin.

The intermediate link may be extended along a third axis, and one end of the intermediate link may be pivotally (rotatably) connected to the other end of the first lever through the first pivot pin, and the other end of the intermediate link may be pivotally connected to the other end of the second lever through the second pivot pin.

One end of the intermediate link may be provided with a first through hole through which the first pivot pin passes, and the other end of the intermediate link may be provided with a second through hole through which the second pivot pin passes.

An axis of the first through hole may intersect with the third axis of the intermediate link at a predetermined angle, and an axis of the second through hole may intersect with the third axis of the intermediate link at a predetermined angle.

One end of the intermediate link may become close to the second lever and the other end of the intermediate link may become close to the first lever in a state in which the flap is located in a closed position, such that the third axis of the intermediate link may be inclined at a predetermined angle of inclination.

One end of the second lever may be provided with a cap portion, one end of the shaft may be pivotally connected to the cap portion, and the cap portion of the second lever and a boss of the valve housing may be disposed to face each other.

A spring may be interposed between the cap portion of the second lever and the boss of the valve housing.

The cap portion may have a first receiving groove, the boss may have a second receiving groove, and the spring may be received in the first receiving groove of the cap portion and the second receiving groove of the boss.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
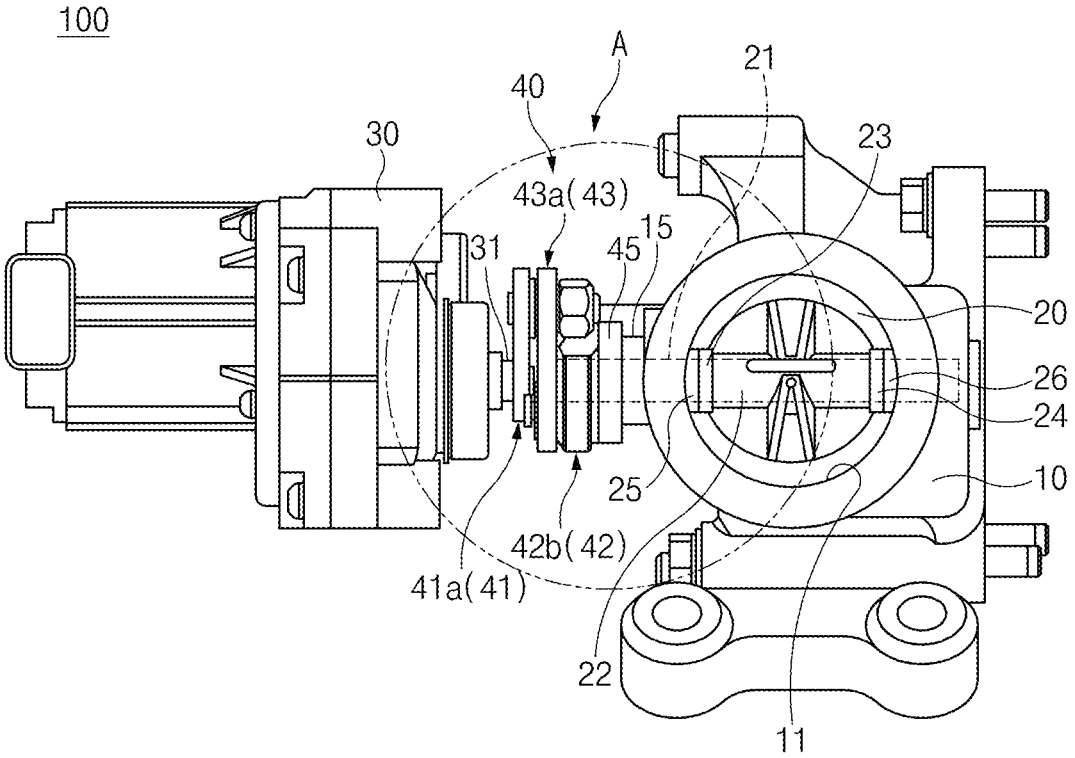
FIG. 1 illustrates the configuration of an exhaust gas recirculation (EGR) valve, according to an embodiment of the present disclosure.

Hereinafter, embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in embodiments of the present disclosure. These teams are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

According to an aspect of the present invention, an exhaust gas recirculation (EGR) system is disclosed. The EGR system includes an exhaust gas recirculation (EGR) pipe for circulating at least part of the exhaust gas from a combustion engine into air intake of the engine. On the EGR pipe, the EGR system includes an EGR valve for opening or closing the EGR pipe.

In embodiments, an EGR valve comprises a housing defining a gas flow path 11, a flap 20 for opening and closing the gas flow path 11, a rotational shaft 21 of the flap 20, a hub 22 connected to the rotational shaft 21, a first bushing 23 and a second bushing 24 provided at ends of the hub 22. In embodiments, the hub 22 and the first bushing 23 moves in a first direction along the rotational (P1 or P2) when a cap portion 45 moves along the first direction (P1 or P2).

Figure 3:
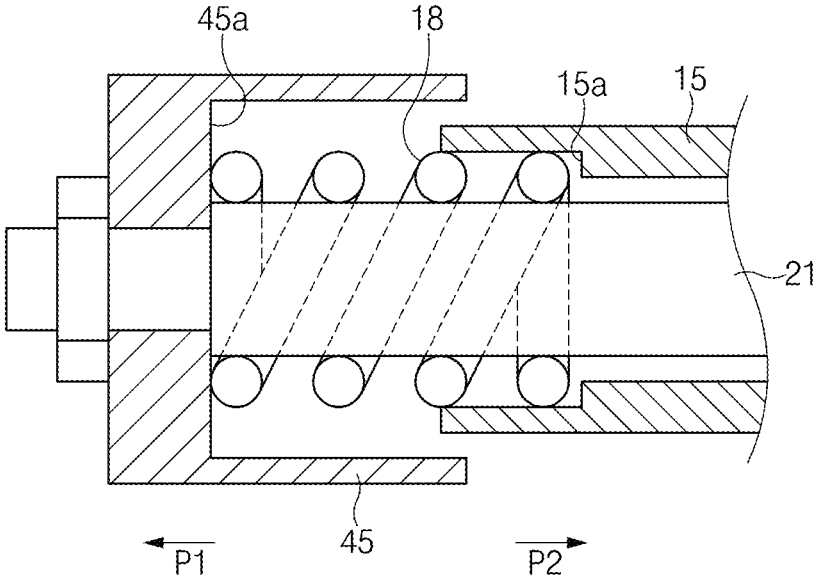
FIG. 3 illustrates a cross-sectional view, taken along line C-C in FIG. 2.
Figure 4:
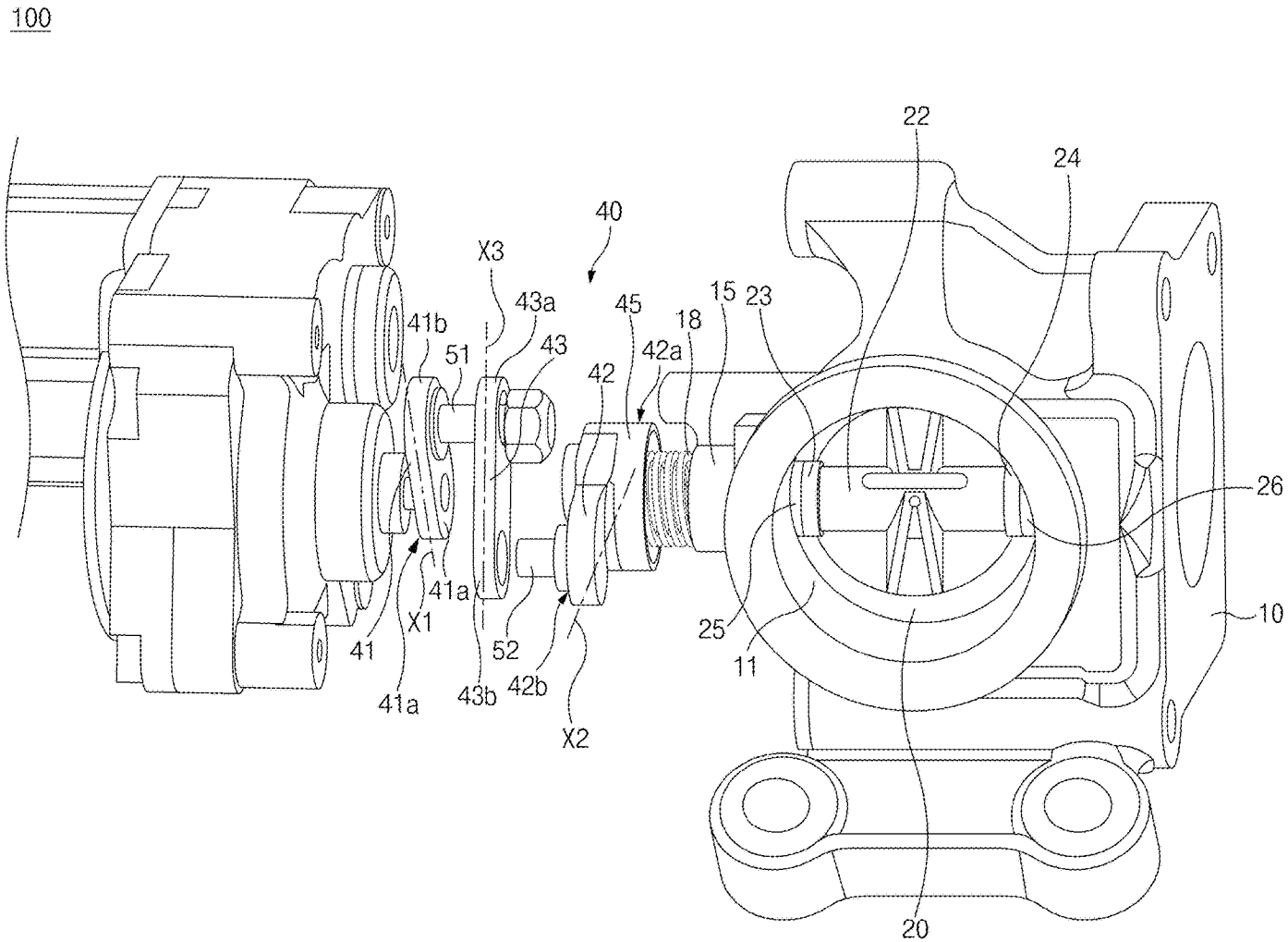
FIG. 4 illustrates an exploded perspective view of a torque transmitting mechanism of an EGR valve, according to an exemplary embodiment of the present disclosure.

In embodiments, in a closing position of the flap 20, the first bushing 23 and the third bushing 25 are contacting each other to close the gas flow path 11. As the actuator operates to rotate the flap from a closing position, due to non-parallel arrangement of the intermediate link 43 (slanted from a parent position 48), the cap portion 45 moves along the direction P2 as illustrated in FIG. 3. Accordingly, the first bushing 23 moves along the direction P2 (away from the actuator 30) such that the first bushing 23 is separated from the third bushing 25 in an opening position of the flap 20. As the actuator operates further and the flap 20 approaches its subsequent closing position, the cap portion 45 moves back along the direction P1 such that the first bushing 23 and a third bushing 25 contacts again in the subsequent closing position of the flap 20.

In embodiments, the second bushing 24 and the fourth bushing 26 contact each other regardless of the flap's position. In embodiments, at least the one of the second bushing 24 and the fourth bushing 26 is elastic such that movement of the hub 22 and the first bushing 23 along a direction parallel to the rotational axis (P1 or P2) can be compensated by elastic deformation of the second bushing 24 and the fourth bushing 26.

Referring to FIG. 1, an exhaust gas recirculation (EGR) valve 100, according to an embodiment of the present disclosure, includes a valve housing 10 having a flow path 11, a flap 20 rotatable to open and close the flow path 11 of the valve housing 10, an actuator 30 generating torque for rotating the flap 20, and a torque transmitting mechanism 40 transmitting the torque of the actuator 30 to the flap 20.

The valve housing 10 may have the flow path 11 through which an EGR gas passes, and be connected to an EGR conduit. As is well known, the EGR conduit may be connected between an exhaust pipe and an intake pipe.

The flap 20 may be rotatably mounted in the inside of the valve housing 10, such that the flap 20 opens and closes the flow path 11 of the valve housing 10 by moving between an open position in which the flow path 11 of the valve housing 10 is open and a closed position in which the flow path 11 of the valve housing 10 is closed.

The flap 20 may have a hub 22, and the hub 22 may receive a shaft 21. The shaft 21 may be coupled to the hub 22, so that the shaft 21 may be coupled to the flap 20, and the shaft 21 may be rotatably mounted in the valve housing 10.

A boss 15 may protrude from an external surface of the valve housing 10. One end of the shaft 21 of the flap 20 may pass through the boss 15 to protrude, and be connected to the torque transmitting mechanism 40.

A first bushing 23 and a second bushing 24 may symmetrically be provided at both ends of the hub 22 of the flap 20. The shaft 21 passing through the hub 22 may be extended along a virtual axis connecting between the first bushing 23 and the second bushing 24. The first bushing 23 may be disposed adjacent to the boss 15 of the valve housing 10, and the second bushing 24 may be disposed on the opposite side of the boss 15.

The third bushing 25 may be disposed adjacent to the boss 15 of the valve housing 10, and the fourth bushing 26 may be disposed on the opposite side of the boss 15. The first bushing 23 and the third bushing 25 may be brought into contact with each other, and the second bushing 24 and the fourth bushing 26 may be brought into contact with each other, and thus the shaft 21 may be rotatably supported by the valve housing 10.

The actuator 30 may be a motor such as an electric motor or a hydraulic motor that generates torque for rotating the flap 20.

The actuator 30 may have a rotatable output shaft 31, and the output shaft 31 of the actuator 30 may be connected to the torque transmitting mechanism 40. The torque of the actuator 30 may be smoothly transmitted to the flap 20 by the torque transmitting mechanism 40.

The torque transmitting mechanism 40 includes a first lever 41 connected to the output shaft 31 of the actuator 30, a second lever 42 connected to the shaft 21 of the flap 20, and an intermediate link 43 connected between the first lever 41 and the second lever 42.

The first lever 41 may be extended along a first axis X1. One end 41*a* of the first lever 41 may be pivotally connected to the output shaft 31 of the actuator 30, and the other end 41*b* of the first lever 41 may be pivotally connected to one end 43*a* of the intermediate link 43 by a first pivot pin 51.

The second lever 42 may be adjacent to the boss 15 of the valve housing 10, and thus the first bushing 23 and the third bushing 25 may be adjacent to the second lever 42.

The second lever 42 may be extended along a second axis X2. One end 42*a* of the second lever 42 may be connected to one end of the shaft 21 of the flap 20, and the other end 42*b* of the second lever 42 may be pivotally connected to the other end 43*b* of the intermediate link 43 by a second pivot pin 52.

The intermediate link 43 may be extended along a third axis X3. One end 43*a* of the intermediate link 43 may be pivotally connected to the other end 41*b* of the first lever 41 through the first pivot pin 51, and the other end 43*b* of the intermediate link 43 may be pivotally connected to the other end 42*b* of the second lever 42 through the second pivot pin 52.

The first pivot pin 51 and the second pivot pin 52 may be individually provided at both ends 43*a* and 43*b* of the intermediate link 43, respectively. Specifically, a first through hole 61 may be formed in one end 43*a* of the intermediate link 43, and the first pivot pin 51 may pass through the first through hole 61; and a second through hole 62 may be formed in the other end 43*b* of the intermediate link 43, and the second pivot pin 52 may pass through the second through hole 62.

When the output shaft 31 of the actuator 30 rotates, the first lever 41, the intermediate link 43, and the second lever 42 may pivot relative to each other. In this manner, power of the actuator 30 may be transmitted to the shaft 21 of the flap 20 to allow the flap 20 to rotate.

For example, when the output shaft 31 of the actuator 30 rotates in one direction, the first lever 41 may pivot on the end 41*a* connected to the output shaft 31. The torque generated by the pivoting of the first lever 41 may be transmitted to the second lever through the intermediate link 43, and the second lever 42 may pivot on the end 42*b* connected to the intermediate link 43, thereby allowing the shaft 21 of the flap 20 to rotate.

The torque transmitting mechanism 40 may be configured as a three-bar linkage to stably transmit the power of the actuator 30 to the flap 20. In addition, the actuator 30 and the valve housing 10 may be spaced apart from each other by the transmitting mechanism 40, and thus the actuator 30 may be protected from high temperature exhaust gases passing through the flow path 11 of the valve housing 10.

According to an embodiment, a cap portion 45 may be provided on one end 42*a* of the second lever 42, and the boss 15 may be provided on a portion of the valve housing 10 adjacent to the second lever 42. One end of the shaft 21 of the flap 20 may pass through the boss 15, and be pivotally connected to the cap portion 45. The cap portion 45 of the second lever 42 and the boss 15 of the valve housing 10 may be disposed to face each other.

According to an embodiment, a spring 18 may be interposed between the cap portion 45 of the second lever 42 and the boss 15 of the valve housing 10. Spring force of the spring 18 may ensure stability in torque transmission when the torque of the actuator 30 is transmitted to the shaft 21 of the flap 20 through the transmitting mechanism 40, and thus the rotation of the flap 20 may be made much smoother.

According to an embodiment, the cap portion 45 may have a first receiving groove 45*a*, and the boss 15 may have a second receiving groove 15*a*. The spring 18 may be received between the first receiving groove 45*a* of the cap portion 45 and the second receiving groove 15*a* of the boss 15. The spring 18 may apply an elastic force that pushes the cap portion 45 in a direction away from the boss 15. Thus, the cap portion 45 of the second lever 42 and the shaft 21 may be elastically supported by the spring 18.

When the flap 20 is located in the closed position, the first bushing 23 of the flap 20 and the third bushing 25 of the valve housing 10 may maintain a state in which they contact each other. In a state in which the flap 20 closes the flow path 11 of the valve housing 10, it may minimize leakage of the EGR gas.

When the flap 20 moves from the closed position to the open position, if the intermediate link 43 is not inclined, that is, the intermediate link 43 is located in a vertical position (see a two-dot chain line 48 in FIG. 2), an external force generated in the shaft 21 by the torque of the second lever 42 and/or the spring force of the spring 18 may intensively be applied to the first bushing 23 of the flap 20 and the third bushing 25 of the valve housing 10, and thus the first bushing 23 of the flap 20 and the third bushing 25 of the valve housing 10 may be brought in frictional contact with each other. The frictional contact of the first bushing 23 and the third bushing 25 may cause at least one of the first bushing 23 and the third bushing 25 to be worn. Due to such a worn state, the operation reliability of the flap 20 may be reduced, and a gap may be formed between the first bushing 23 and the third bushing 25 even in a state in which the flap 20 closes the flow path 11 of the valve housing 10, and a portion of the EGR gas may be leaked even when the EGR valve is closed, and thus the flow control of the EGR gas may not be smoothly achieved.

Therefore, when the flap 20 moves from the closed position to the open position, the third axis X3 of the intermediate link 43 may be inclined relative to the first axis X1 of the first lever 41 and the second axis X2 of the second lever 42 to prevent the frictional contact between the first bushing 23 and the third bushing 25.

Figure 2:
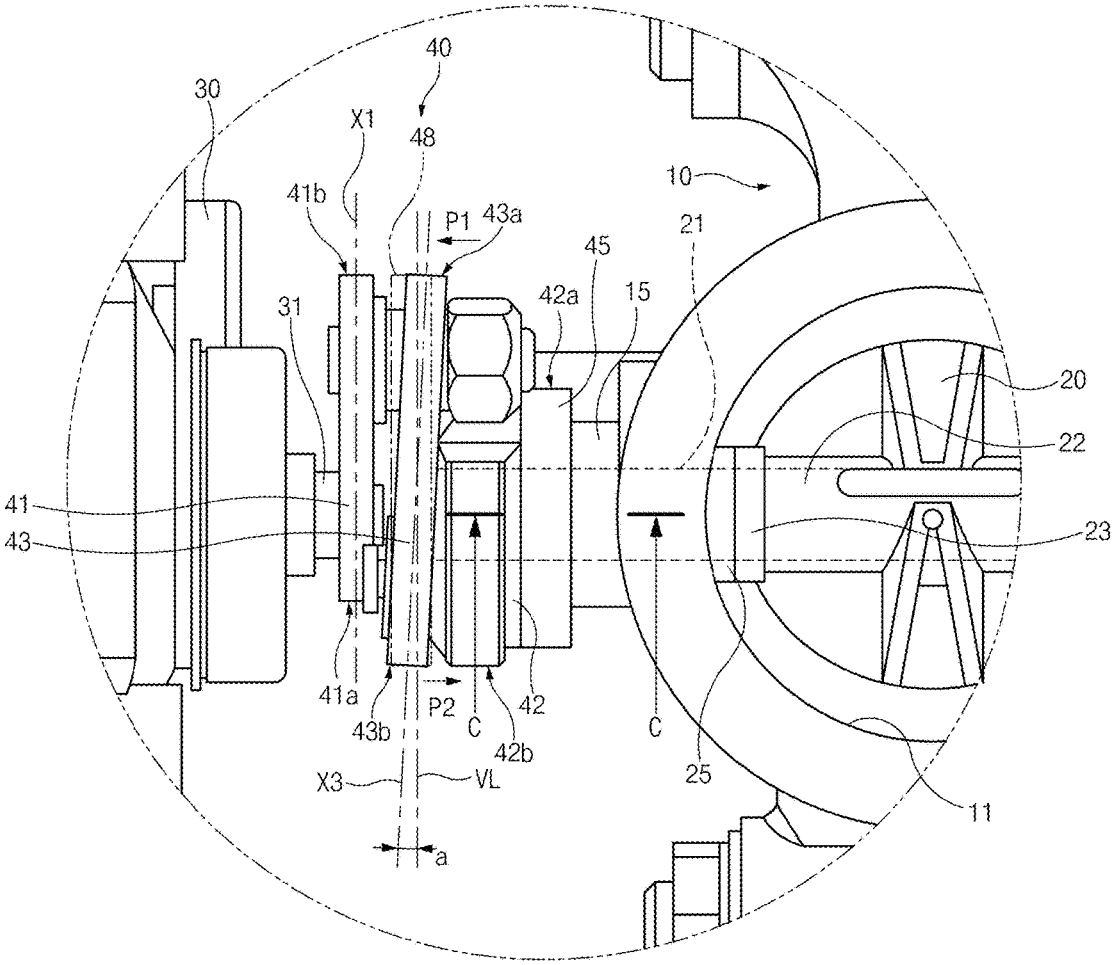
FIG. 2 illustrates an enlarged view of a portion indicated by arrow A in FIG. 1.

According to an embodiment, in a state in which the flap 20 is located in the closed position, the third axis X3 of the intermediate link 43 may be located in an inclined position that intersects with a vertical line VL at a predetermined angle a of inclination on a front view of the EGR valve 100, as illustrated in FIG. 2. For example, the angle a of inclination may be approximately 1.2°. When the angle a of inclination is larger than 1.2°, a gap between the intermediate link 43 and the second lever 42 may be narrow, and thus an operating load may be large. When the angle a of inclination is smaller than 1.2°, the improved effect may be insufficient.

As illustrated in FIG. 2, in the state in which the flap 20 is located in the closed position, one end 43*a* of the intermediate link 43 may become close to the second lever 42 and be spaced apart from the first lever 41, and the other end 43*b* of the intermediate link 43 may become close to the first lever 41 and be spaced apart from the second lever 42. In this manner, the third axis X3 of the intermediate link 43 may be inclined at the predetermined angle a of inclination with respect to the first axis X1 of the first lever 41 and the second axis X2 of the second lever 42.

In the state in which the flap 20 is located in the closed position and the third axis X3 of the intermediate link 43 is inclined at the predetermined angle a of inclination, when the output shaft 31 of the actuator 30 rotates in one direction to allow the flap 20 to move to the open position, the first lever 41 may pivot, and due to the torque generated by the pivoting of the first lever 41, one end 43*a* of the intermediate link 43 connected to the other end 41*b* of the first lever 41 may be pulled toward the first lever 41 (see a direction of arrow P1 in FIG. 2), while the other end 43*b* of the intermediate link 43 may push the second lever 42 toward the valve housing 10 (see a direction of arrow P2 in FIG. 2), and the cap portion 45 of the second lever 42 and the shaft 21 of the flap 20 may be moved to be spaced apart from the boss 15 of the valve housing 10 (see the direction of arrow P2 in FIG. 3), and thus the first bushing 23 of the flap 20 may be moved to be spaced apart from the third bushing 25 of the valve housing 10 (see the direction of arrow P2 in FIG. 2). Therefore, the third axis X3 of the intermediate link 43 may be moved from the inclined position in which the third axis X3 is inclined at the predetermined angle a of inclination to be substantially close to the vertical position (see the two-dot chain line 48 in FIG. 2).

Here, as the shaft 21 moves in the direction of arrow P2 of FIG. 3, the second bushing 24 of the flap 20 and the fourth bushing 26 of the valve housing 10 may contact each other. However, due to the spring 18 and thermal expansion, the second bushing 24 and the fourth bushing 26 may not be brought in frictional contact with each other.

As the flap 20 moves from the closed position to the open position, the intermediate link 43 may move from the inclined position to the vertical position. As the shaft 21 of the flap 20 moves to be spaced apart from the boss 15 of the valve housing 10 (see the direction of arrow P2 in FIG. 3), the first bushing 23 and the third bushing 25 adjacent to the second lever 42 may be spaced apart from each other, and thus the first bushing 23 and the third bushing 25 may be prevented from being worn.

Figure 6:
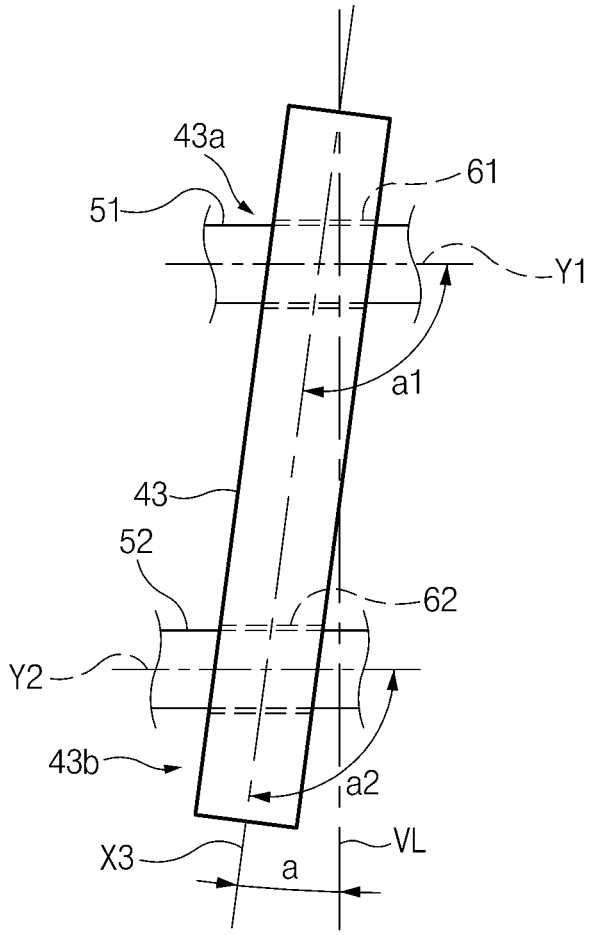
FIG. 6 illustrates a front view of an intermediate link of an EGR valve, according to an embodiment of the present disclosure.

As illustrated in FIG. 6, an axis Y1 of the first through hole 61 and an axis Y2 of the second through hole 62 may be parallel to each other, and the axis Y1 of the first through hole 61 and the axis Y2 of the second through hole 62 may be extended in a horizontal direction. As the third axis X3 of the intermediate link 43 is inclined at the predetermined angle a of inclination with respect to the vertical line VL, the axis Y1 of the first through hole 61 and the third axis X3 of the intermediate link 43 may intersect at an obtuse angle a1 slightly larger than 90°, and the axis Y2 of the second through hole 62 and the third axis X3 of the intermediate link 43 may intersect at an obtuse angle a2 slightly larger than 90°.

An inner diameter of the first through hole 61 may be larger than an outer diameter of the first pivot pin 51, and an inner diameter of the second through hole 62 may be larger than an outer diameter of the second pivot pin 52. Thus, when the intermediate link 43 moves from the inclined position to the vertical position, the degree of wear between the through holes 61 and 62 of the intermediate link 43 and the pivot pins 51 and 52 may be minimized.

Figure 5:
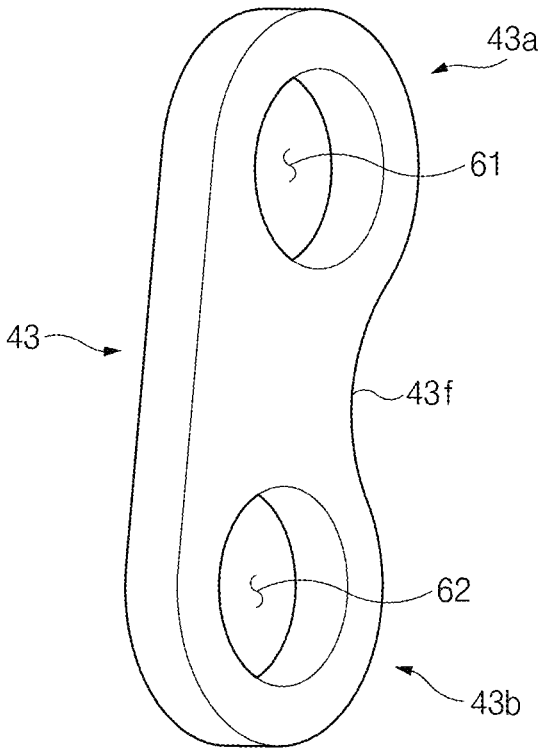
FIG. 5 illustrates a perspective view of an intermediate link of an EGR valve, according to an embodiment of the present disclosure.

In addition, a central portion of the intermediate link 43 may be recessed to form a curved surface portion 43*f* as illustrated in FIG. 5. The curved surface portion 43*f* may reduce the weight of the intermediate link 43, and improve the operability of the intermediate link 43.

Figure 7:
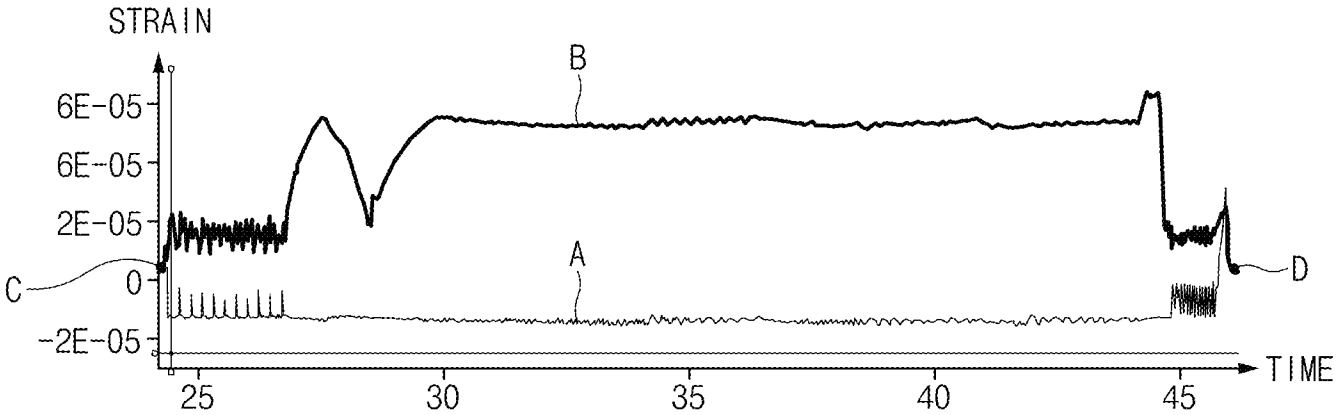
FIG. 7 illustrates a comparison graph of strain applied to a shaft of a flap in an EGR valve having a structure in which an intermediate link is inclined and in an EGR valve having a structure in which the intermediate link is not inclined, according to an embodiment of the present disclosure.

FIG. 7 illustrates a comparison graph of strain applied to a shaft of a flap in an EGR valve having a structure in which an intermediate link is inclined and in an EGR valve having a structure in which the intermediate link is not inclined.

In FIG. 7, line A indicates a value obtained by measuring strain applied to the shaft 21 of the flap 20 when the flap 20 moves from the closed position to the open position, after a strain gauge is mounted on the shaft 21 of the flap 20 in the structure of the EGR valve 100 in which the intermediate link 43 is not inclined. It can be seen that when the flap 20 moves from the closed position (point C) to the open position and moves back to the closed position (point D), the strain applied to the shaft 21 of the flap 20 has a negative value. Thus, it can be seen that when the flap 20 moves from the closed position to the open position, a compressive load is applied to the shaft 21 of the flap 20.

As indicated by line A of FIG. 7, when the intermediate link 43 is not located in the inclined position, that is, the intermediate link 43 is located in the vertical position (see the two-dot chain line 48 in FIG. 2), the external force generated in the shaft 21 by the torque of the second lever 42 and/or the spring force of the spring 18 may intensively be applied to the first bushing 23 of the flap 20 and the third bushing 25 of the valve housing 10, and thus the first bushing 23 of the flap 20 and the third bushing 25 of the valve housing 10 may be brought in frictional contact with each other. Due to the frictional contact, the compressive load may be applied to the shaft 21 of the flap 20.

In FIG. 7, line B indicates a value obtained by measuring strain applied to the shaft 21 of the flap 20 when the flap 20 moves from the closed position to the open position, after the strain gauge is mounted on the shaft 21 of the flap 20 in the structure of the EGR valve 100 in which the intermediate link 43 is inclined. It can be seen that when the flap 20 moves from the closed position (point C) to the open position and moves back to the closed position (point D), the strain applied to the shaft 21 of the flap 20 has a positive value. Thus, it can be seen that when the flap 20 moves from the closed position to the open position, a tensile load is applied to the shaft 21 of the flap 20.

As indicated by line B of FIG. 7, when the flap 20 moves from the closed position to the open position in a state in which the intermediate link 43 is inclined, the cap portion 45 of the second lever 42 and the shaft 21 of the flap 20 may be moved to be spaced apart from the boss 15 of the valve housing 10 (see the direction of arrow P2 in FIG. 3), and thus the first bushing 23 of the flap 20 may be moved to be spaced apart from the third bushing 25 of the valve housing 10 (see the direction of arrow P2 in FIG. 2). It can be seen that as the first bushing 23 and the third bushing 25 are spaced apart from each other, the tensile load is applied to the shaft 21 of the flap 20.

According to embodiments of the present disclosure, the EGR valve may be capable of ensuring the structural safety for smoothly transmitting the power of the actuator to the flap to thereby provide the stable opening and closing performance, and preventing the wear occurring between the external surface of the flap and the internal surface of the valve housing.

According to embodiments of the present disclosure, when the flap is located in the closed position, the axis of the intermediate link may be inclined at a predetermined angle of inclination based on the vertical line, and when the flap moves from the closed position to the open position, the intermediate link may be moved from the inclined position to the vertical position and the first bushing and the third bushing adjacent to the second lever may be spaced apart from each other, and thus the first bushing and the third bushing may be prevented from being worn.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. An exhaust gas recirculation (EGR) valve, comprising:

a valve housing having a flow path;

a flap configured to open and close the flow path of the valve housing, the flap having a shaft and a hub configured to receive the shaft;

an actuator configured to generate torque for rotating the flap; and a torque transmitting mechanism configured to transmit the torque of the actuator to the flap, wherein the torque transmitting mechanism includes a first lever connected to an output shaft of the actuator, a second lever connected to the shaft of the flap, and an intermediate link connecting the first lever and the second lever, wherein a first bushing and a second bushing are symmetrically provided at both ends of the hub, wherein a third bushing and a fourth bushing are provided on an internal surface of the valve housing, and wherein as the flap moves from a closed position in which the flow path of the valve housing is closed to an open position in which the flow path of the valve housing is open, the intermediate link is configured to move from an inclined position to a vertical position, and the first bushing is configured to move from a contacting position in which the first bushing contacts the third bushing to a separated position in which the first bushing is separated from the third bushing, wherein one end of the intermediate link is pivotally connected to one end of the first lever through a first pivot pin, and the other end of the intermediate link is pivotally connected to one end of the second lever through a second pivot pin, wherein one end of the intermediate link is provided with a first through hole through which the first pivot pin passes, and the other end of the intermediate link is provided with a second through hole through which the second pivot pin passes, wherein an axis of the first through hole intersects with an axis of the intermediate link at a predetermined angle, and an axis of the second through hole intersects with the axis of the intermediate link at a predetermined angle, wherein one end of the intermediate link becomes close to the second lever and the other end of the intermediate link becomes close to the first lever in a state in which the flap is located in a closed position, such that the axis of the intermediate link is inclined at a predetermined angle of inclination, wherein an inner diameter of the first through hole is larger than an outer diameter of the first pivot pin such that a gap is provided between the first through hole and the first pivot pin and contact between the first through hole and the first pivot pin as the intermediate link moves from the inclined position to the vertical position is reduced, and an inner diameter of the second through hole is larger than an outer diameter of the second pivot pin such that a gap is provided between the second through hole and the second pivot pin and contact between the second through hole and the second pivot pin as the intermediate link moves from the inclined position to the vertical position is reduced.

2. The EGR valve according to claim 1, wherein the first lever is extended along a first axis, and one end of the first lever is pivotally connected to the output shaft of the actuator, and the other end of the first lever is pivotally connected to one end of the intermediate link by the first pivot pin.

3. The EGR valve according to claim 2, wherein the second lever is extended along a second axis, and one end of the second lever is connected to one end of the shaft, and the other end of the second lever is pivotally connected to the other end of the intermediate link by the second pivot pin.

4. The EGR valve according to claim 1, wherein one end of the second lever is provided with a cap portion, one end of the shaft is pivotally connected to the cap portion, and the cap portion of the second lever and a boss of the valve housing are disposed to face each other.

5. The EGR valve according to claim 4, wherein a spring is interposed between the cap portion of the second lever and the boss of the valve housing.

6. The EGR valve according to claim 5, wherein the cap portion has a first receiving groove, the boss has a second receiving groove, and the spring is received in the first receiving groove of the cap portion and the second receiving groove of the boss.

* * * * *